US007116224B2

(12) United States Patent
Mickler

(10) Patent No.: US 7,116,224 B2
(45) Date of Patent: Oct. 3, 2006

(54) METHOD AND APPARATUS FOR SECURING FIREARMS AND OTHER VALUABLES IN AN ALARM PROTECTED FACILITY

(76) Inventor: Kerry L. Mickler, 14 Curry La., Milford, OH (US) 45150

( * ) Notice: Subject to any disclaimer, the term of this patent is extended or adjusted under 35 U.S.C. 154(b) by 194 days.

(21) Appl. No.: 10/681,432

(22) Filed: Oct. 8, 2003

(65) Prior Publication Data

US 2004/0066275 A1 Apr. 8, 2004

Related U.S. Application Data

(60) Provisional application No. 60/417,045, filed on Oct. 8, 2002.

(51) Int. Cl.
*G08B 13/14* (2006.01)

(52) U.S. Cl. ..... 340/568.1; 340/506; 340/521; 70/63; 109/38; 206/317

(58) Field of Classification Search ..... 340/568.1, 340/568.8, 506; 206/317; 70/63; 109/38
See application file for complete search history.

(56) References Cited

U.S. PATENT DOCUMENTS

| | | | | |
|---|---|---|---|---|
| 2,797,405 | A | 6/1957 | Stelter | |
| 5,048,682 | A | 9/1991 | Taylor | |
| 5,111,755 | A * | 5/1992 | Rouse | 109/25 |
| 5,161,396 | A | 11/1992 | Loeff | |
| 5,196,827 | A | 3/1993 | Allen et al. | |
| 5,227,776 | A * | 7/1993 | Starefoss | 340/825.36 |
| 5,236,086 | A * | 8/1993 | MacTaggart | 206/317 |
| 5,416,472 | A | 5/1995 | Torii, Jr. | |
| 5,416,826 | A | 5/1995 | Butler | |
| 5,525,966 | A * | 6/1996 | Parish | 340/568.1 |
| 5,598,151 | A * | 1/1997 | Torii, Jr. | 340/5.33 |
| 5,621,996 | A | 4/1997 | Mowl, Jr. | |
| 5,916,087 | A | 6/1999 | Owens | |
| 5,987,941 | A | 11/1999 | Zocco | |
| 6,400,269 | B1 * | 6/2002 | Savastano | 340/568.1 |
| 2004/0113783 | A1 * | 6/2004 | Yagesh | 340/568.1 |

* cited by examiner

*Primary Examiner*—Jeffery Hofsass
*Assistant Examiner*—Samuel Walk
(74) *Attorney, Agent, or Firm*—Wood, Herron & Evans, L.L.P.

(57) ABSTRACT

An alarm ready portable case is provided in which to secure a firearm or other protectable. The case includes sensors, a lock and, in several embodiments, structure to support the article to be protected. The case is adaptable to become part of a pre-existing facility security system of any of a plurality of manufacturers by being configured to receive any of several connectivity elements that are compatible with at least one of the security systems. For example, wireless transmitters that are compatible with different alarm systems may be connected. Terminals may also be directly wired into a hardwired zone of a security alarm panel. Transmitter receiving structure may be provided in the case for holding any such transmitter. Terminals are provided to connect to external wiring. Slots may be provided for communication interface cards, such as ethernet cards, wireless telecommunications cards, or other connectivity hardware. Internal conductors are provided in the case to connect the sensors to the transmitter, external wiring or other connectivity devices. The sensors may be normally closed switches that are opened when the lid or the lock of the case are opened, motion detectors that actuate when the case is moved, or other detection devices that generate a signal when the case is otherwise tampered with. The case provides an efficient way of retrofitting an existing facility alarm or security system to specifically protect a firearm or other protectable item.

21 Claims, 1 Drawing Sheet

METHOD AND APPARATUS FOR SECURING FIREARMS AND OTHER VALUABLES IN AN ALARM PROTECTED FACILITY

This application claims priority to U.S. Provisional Patent Application Ser. No. 60/417,045, filed Oct. 8, 2002, hereby expressly incorporated herein by reference.

FIELD OF THE INVENTION

This invention relates to security and, more particularly, to a storage device for use in securing firearms or other valuables or protectables in an environment protected by an alarm system or other security or monitoring system.

BACKGROUND OF THE INVENTION

Facility security systems are available from a variety of vendors and installers and can be provided with a variety of features and with various levels of sophistication. Most systems require elections to be made at the time of initial installation. Upgrades or modifications to these systems often involve reconfiguration of the system at added cost, and many of these are limited by vendor-specific accessories provided by or for the original system manufacturer. Typically, the need arises for owners and users of such systems to add zones, specific objects or enclosures to pre-existing installations. Accordingly, there is a need to provide for the extension of pre-existing systems with a maximum of flexibility and a minimum of cost.

The addition of safes, vaults, displays and specific items of property to a secured or protected premises may call for the addition of additional sensors to an existing system and additional enclosures for certain valuable items, such as documents, jewelry, and particularly firearms. It might be desirable to allow such additions to be secured or monitored even when an overall premises alarm is disabled. Furthermore, the manufacture of accessories specially configured for protecting specific articles might not be cost justified where such accessories are compatible with only one manufacturer's security system.

The need to safely secure firearms, for example, has produced a number of specialty products, including, for example, trigger locks, gun safes, gun drawers, gun cases, gun cables, barrel locks, locking gun racks, finger print identifiers, trigger pins and other devices. Each device is intended to make gun ownership safer, but many have undesired side effects that arise from their design or use. Furthermore, essentially all such devices are incapable of detecting unauthorized access to a firearm and alerting an outside authority when the weapon is compromised. Advancements in technology have not been effectively used to address gun safety, and particularly, to provide secure yet convenient gun storage.

The use of alarm systems in securing firearms typically involves the installation of permanent hardware to the facility in which guns are kept. If such features are not included at the time of facility construction or security system installation, expensive retrofitting is required which deters the incorporation of firearm protection into existing facility security systems. Furthermore, providing alarm equipped portable or firearm specific enclosures is complex and costly, further posing an obstacle to those seeking safe gun storage.

U.S. Pat. Nos. 2,797,405; 5,416,826; 5,598,151 and 5,987,941, for example, are some that disclose security features. U.S. Pat. No. 2,797,405 to Stelter shows facility alarm systems that have been adapted to protect portable containers for valuables. U.S. Pat. No. 5,416,826 to Butler discloses a gun safe that is hard wired to a phone line to notify authorities when security is breached. It discloses detection of emergency and non-emergency conditions and the transmission of emergency and 911 signals over the phone lines. It acknowledges that an alarm signal has been transmitted in prior systems when a gun safe is breached without authorized entry. U.S. Pat. No. 5,598,151 to Torii discloses a firearm security system having the features of the Butler system and contemplating the use of wireless communications. U.S. Pat. No. 5,987,941 to Zocco discloses a wall safe for a firearm and lists a number of features in FIG. 7 that are not explained in detail in the written specification. None of these patents discloses a gun storage system or a system for protecting items in general that makes it easy to take advantage of the features of an existing alarm or security system.

Accordingly, there remains a need for an improved method and apparatus for securing firearms or other valuables or protectables in an alarm-protected facility or in an environment otherwise protected by a security or monitoring system.

SUMMARY OF THE INVENTION

An objective of the present invention is to provide a method and apparatus for securing firearms, valuables or other protectables. A particular objective of the invention is to provide a secure compartment or case that can be protected by an electronic alarm system or other security or monitoring system at low cost. A further objective of the invention is to provide a flexible and efficient method and apparatus that utilizes the protective features of a preexisting electronic facility security or monitoring system.

A further objective of the present invention is to provide a case, compartment or other security accessory that can be used to supplement a security or monitoring system of a plurality of different system vendors. A more particular objective of the invention is to provide such an accessory having a capability for interfacing or communicating with components of a pre-existing or pre-installed premises security or monitoring system that is located on the premises or remote from the premises.

According to the principles of the present invention, an alarm-ready security accessory, such as a securable case or compartment, is provided for protecting a firearm or other valuable or protectable item. The case is adaptable to a facility security or monitoring system having an alarm or other alerting or monitoring electronics. By "alarm-ready" is meant that the accessory is configured to detect and communicate some condition, but that it may require the addition of a component for specifically adapting the accessory to, or interfacing the accessory with, the system to which it is being added or is supplementing. The component is typically a hardware item or device but may also or alternatively include or be in the of software.

According to an illustrated embodiment of the invention, a case is provided, having a lock and condition sensors configured to detect one or more events such as attempts to open, move, cut or otherwise tamper with the case. Structure and wiring in the case adapts the case to be connected into communication with a pre-existing facility security or monitoring system. In certain embodiments, such a case is adapted to receive any one of several types of wireless transmitters provided by various facility alarm system vendors to couple alarm signals from alarm condition sensors to their alarm systems. The case is adapted to be connected into any of such alarm systems by incorporating an element linking it to such pre-existing system. Such a case may be provided with structure to accommodate the wireless transmitter of, or compatible with, a security or monitoring system of a chosen system vendor, although connectivity hardware other than a wireless transmitter may be provided for integrating the case into a security system.

The typical embodiments of the present invention supplement a hardware unit of a security system installed for premises protection. The facility system, in its most common form, is installed with sensors connected to its inputs, some hard wired and others using wireless transmitters. Some sensors that are provided detect intrusion while others may detect fire. The intrusion sensors can be armed and disarmed, depending on whether or not the premises are occupied. The system may include an alarm or other output device to annunciate the detection of an alarm condition on the premises, or may include a telephone, wireless or other communication link to a monitoring facility.

The case according to the present invention is "alarm ready" but is packaged and marketed as such unconnected to a security system. The case is configured to receive connectivity hardware or software that will enable the case to communicate, to a security system or monitoring facility, the conditions detected by sensors contained by the case. The most common embodiments of the invention are adapted to receive and connect via a wireless transmitter with a security system panel, although provision for hard wired connections to such unit may be provided. The case may also or in the alternative be configured to communicate with an alarm monitoring facility or other outside or remote entity, and may be provided with other forms of connectivity for that purpose, using Ethernet, cellular telecommunications or other technologies that are or become available. Such cases may be configured to connect to an interface card or circuit to make such connections. In addition, GPS communication capability may be provided.

According to certain features of the invention, the case per se is made available as an uninstalled case, without a transmitter, that can be used as a portable case for carrying a firearm or other protectable, and can be placed and used in a stationary location for securing the firearm or other protectable item. The case can be installed in an existing alarm protected facility by equipping it with a transmitter or other communication element that is suited for use with the facility security or monitoring system. This connection of the case, couples alarm condition sensors that are provided in the case to the facility alarm system and integrates the case to the secured facility. So integrated, the case is in communication with the facility alarm system. The case per se, with a wireless transmitter installed or other connection made, becomes functionally part of a facility security or monitoring system. The integration of the case into a facility alarm system, for example, provides a flexible and economic method both of protecting the contents of the case and of expanding the functions of the facility alarm system. The case, the system into which it is integrated and the method by which it is used, are particularly suitable for securing firearms.

In the illustrated embodiment, the case is configured to receive any of several wireless transmitters for connection to a variety of existing alarm systems of different manufacturers. The case is provided with sensors and is configured to receive transmitters of different types for connection to the sensors. Typically, basic alarm sensors report alarm conditions by breaking a normally closed electrical circuit. Alarm system transmitters typically respond to an open circuit across a pair of terminals and, in response thereto, transmit an RF or other wireless signal to a receiver to report the detection of an alarm condition to the facility or premises alarm system control panel or to otherwise respond to the detection of a condition or event. Sensors and the transmitters may be made to respectively generate and respond to different detection signals to provide more sophisticated detection or to transmit information concerning the nature of the alarm condition or to communicate other information to the facility control panel or other monitoring equipment. The information may include, for example, GPS information, for example to track the case if stolen. When enabled, the transmitter can operate like any of several other sensors of a facility alarm system to signal various alarm conditions to the facility alarm system. The facility alarm system may, in turn, report to a remote central monitoring office and may also sound an alarm condition signal on the premises.

In accordance with principles of the present invention, a selection of alarm ready long gun and handgun storage cases is provided that each can universally adapt to a variety of security systems as a wireless alarm sensor device. The case detects unauthorized access to its contents, such as a firearm stored within it, and, through a premises alarm system or other communication method, alerts authorities at a remote monitoring facility or other processing entity. It provides responsible gun owners with a way to prevent unauthorized access to their firearms while readily allowing access to the firearms for their authorized uses.

The case is preferably equipped with a locking mechanism and a variety of different condition sensing devices that are mechanical and do not require an internal power source. A wireless transmitter that is used to integrate this devise with an alarm system is provided with its own internal power supply. Alternatively, the case may utilize an electronic locking mechanism and other internal electronic devices, in which situation an internal power supply for the electronics is provided.

The case may be designed to detect access to its interior, either authorized or unauthorized, movement of the case from its secured position or otherwise relative to the facility, also authorized or unauthorized, and tampering. The case is also equipped to allow access to the firearm by an authorized user who is under duress or in emergency situations. The case may also be provided with a GPS transmitter to enable locating of the case if it is stolen from the premises.

The case per se, according to certain features of the invention, includes a penetration resistant container having a base and an openable lid with a lock for locking the lid to the base to secure the contents. The interior of the case is configured with transmitter-receiving structure which, when fitted with a transmitter, operates as a wireless ancillary device with substantially any security system. The support structure is designed to accommodate substantially any of several wireless transmitters of the manufacturers of such systems. Wiring for internal alarm sensors of the case terminates proximate the receiving structure. The case, by being "alarm ready", is fully functional as a security device when purchased, and only requires the addition of a transmitter or other connectivity hardware to integrate it into a security system.

The use of wireless transmitters provides ease in retrofitting a facility security system and provides the flexibility in positioning a case at a variety of locations within the facility. While most security equipment manufacturers presently offer wireless security components, some do not, while others utilize older style wireless transmitters that may not conveniently fit in some versions of transmitting/receiving structure of the case of some embodiments of the invention. For such applications, components may be made available to universally adapt the case to use a transmitter compatible with a facility security system. Some transmitters have the ability to report multiple events, for example, by coding the signal differently in response to different detected alarm conditions. In addition to alarm signals from unauthorized access, wireless transmitters can signal weak battery life and tamper alerts to its control panel.

In the illustrated embodiment, the transmitters are self-contained, battery-powered devices with hardwire input terminals capable of transmitting alarm data via radio frequency to a compatible receiving unit located in, or adjacent to, an electronic security system control panel. The sensors in the case operate to detect access through a magnetic switch on the moveable and stationary portions of the case. If a correct lock combination is entered prior to opening the lid, access is authorized, and a bypass prevents the transmitter from signaling an alarm condition. Alternatively, if access is unauthorized, the wireless transmitter is not bypassed, an alarm condition occurs, and a signal is sent to the control panel to alert authorities.

Monitoring the case's fixed location allows a gun owner to leave their weapon unattended. When a case is moved, its movement is detected and the security system is signaled to sound an alarm. Structure in the base of the case may be provided which cooperates with a sensor to report this condition, which allows for simple attachment to a fixed surface, or, alternatively, a motion sensing device in the case may be provided.

These and other objectives and advantages of the present invention will be more readily apparent from the following detailed description.

DETAILED DESCRIPTION

Figure 1:
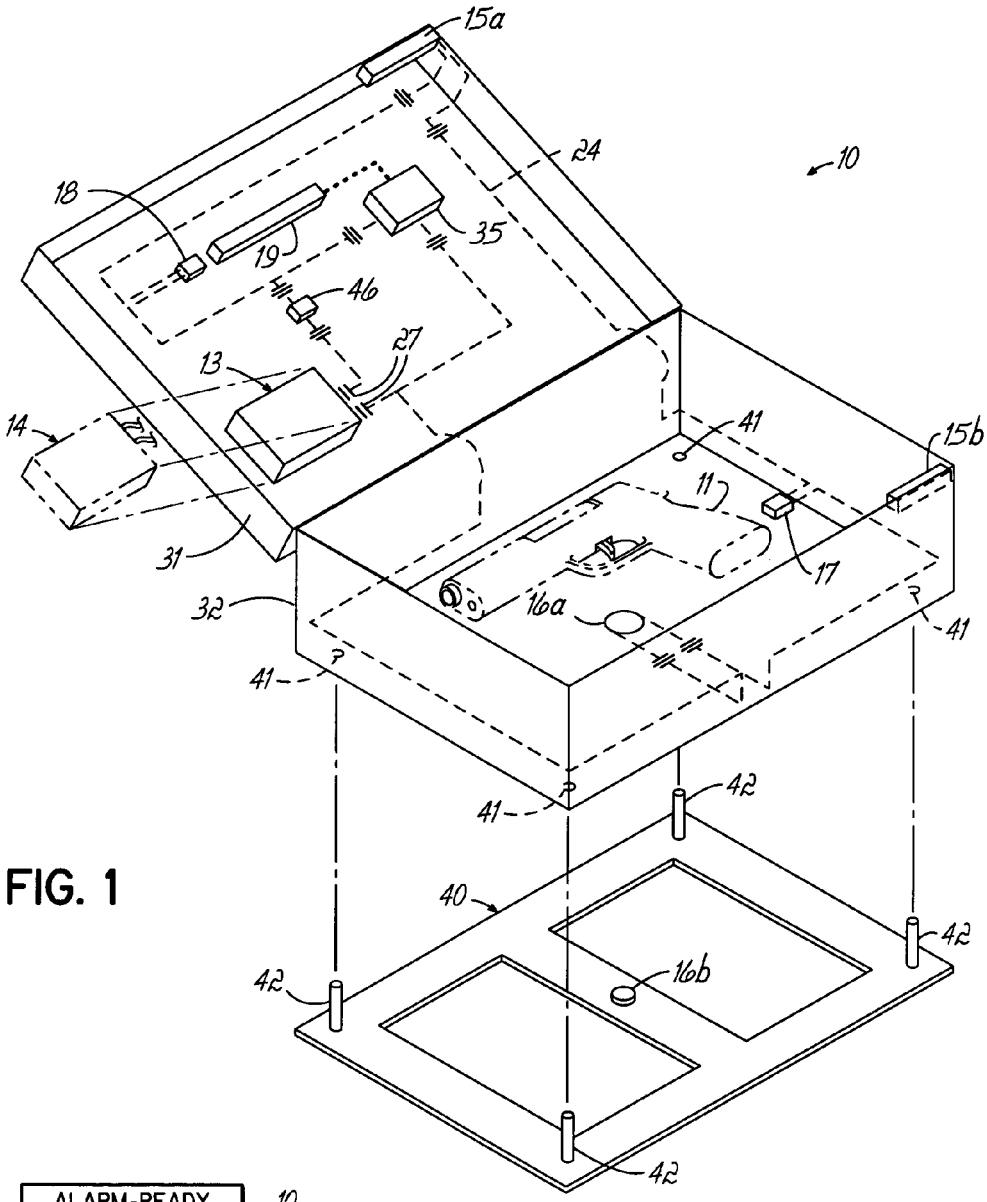
FIG. 1 is a perspective view of an alarm ready protective case according to one embodiment of the present invention.
Figure 2:
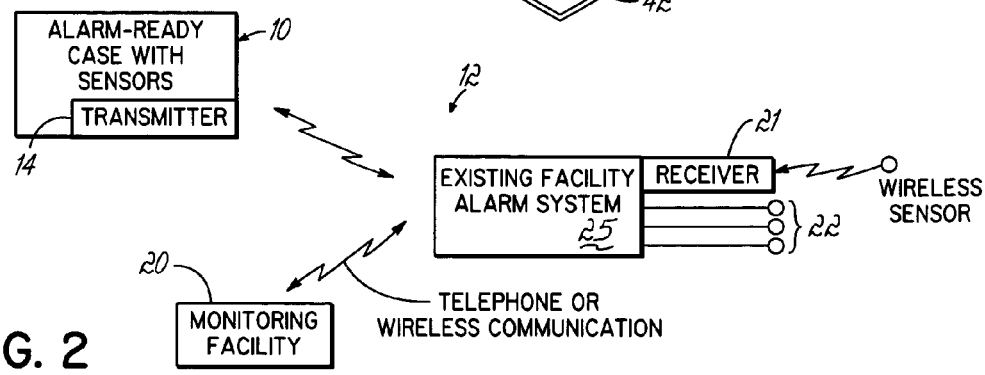
FIG. 2 is a diagrammatic representation of a facility security system with the alarm ready case of FIG. 1 installed.

FIG. 1 illustrates one embodiment of an alarm ready case 10. The case 10 is illustrated as equipped for storage of a handgun 11. An alternative configuration (not shown) of the gun case 10 is similarly adapted for storage of a long gun. The case 10 is further configured to universally adapt to any one of several different facility security systems 12, an example of which is illustrated in FIG. 2, that are equipped with electronic alarms, so that the case can be integrated into such systems 12 as a wireless device component of the system 12. This integration is achieved, in the illustrated embodiment, by equipping the case with structure 13 designed to accept a wireless alarm condition signal transmitter 14 of whatever type may be provided for use with any of a number of security systems 12 which the gun owner may have or be about to install.

The case 10 is provided with one or more sensors 15–18, which operate to detect attempted unauthorized access to, theft of or use of a firearm 11 contained within the case 10. Through the facility alarm system 12, detection can result in the activation of an alarm condition detection feature of the security system 12 and alerting of authorities in a monitoring facility 20. This allows gun owners to prevent unauthorized access to their firearms while readily allowing access for their authorized use.

More particularly, the gun case 10 is equipped with a lock or locking mechanism 19 and a variety of alarm condition sensors 15–18. The lock and the sensors can be active devices that use electrical energy, for example as supplied by batteries. Advantages are realized instead, however, by the use of a passive mechanical locking mechanism and mechanical switch equipped sensors that do not require a power source. Switch 15 (15*a*, 15*b*) is provided to detect the opening of the box. Switch 16 is provided to detect the removal of the box from its resting place. Switch 18 is provided to detect tampering with the lock 19, while switch 17 represents any of a number of other sensors that may be provided to detect vibrations, motion or other conditions.

Wireless transmitter 14 is used to integrate this case 10 with an alarm system 12. Transmitters 14 are typically provided as accessories by the vendors of security systems 12. These transmitters 14 are equipped with electronics for sending an alarm signal to a receiver 21 which triggers the alarm system, in response to a received signal from the transmitter 14, as it does with any of several other perimeter intrusion or motion detection sensors 22 that may be hard wired or otherwise connected to the system 12. Transmitters 14 are typically provided with their own internal battery powered power supply. Terminals may also be provided for direct wiring of the case to a security system or other external device.

The case 10 may be equipped with sensors 15–18 that are designed to detect access, either authorized, unauthorized or both, to the case 10, movement of the case 10, also either authorized, unauthorized or both, and tampering with the case 10 or the lock 19. The case 10 may also be equipped with a panic button or to otherwise signal duress or other emergency situation. Wireless transmitters 14 may be selected that respond differently to different alarm conditions, and the system 12 may be provided with programming or other logic to recognize these different conditions and respond accordingly.

The case 10 is furnished in an "alarm ready" state, so that it can be used with any of a plurality of systems 12 upon installation of a system compatible transmitter 14. When fitted with a transmitter 14, the case 10 operates as a wireless ancillary device with any such security system 12. A portion of the interior of the case 10 is equipped with the structure 13 that is configured as a transmitter holder or to otherwise receive a transmitter. Such structure is dimensioned to accommodate wireless alarm condition transmitters 14 of types available from the manufacturers of, or compatible with, all of the security systems 12 with which the case 10 is intended to be useful. Wiring 24 for the internal alarm sensors 15–18 of the case 10 terminates in the transmitter holder. The "alarm ready" case 10 is fully functional as a security device when purchased, and only requires the addition of a transmitter 14 or other connectivity hardware to integrate the case 10 with a security system 12.

For ease in retrofitting a security system 12 and providing a high degree of flexibility in positioning a case 10, transmitters 14 of the wireless type are preferred for alarm system integration. Most security equipment manufacturers offer wireless security components. For those that do not, or for those systems that utilize older style wireless transmitters that might not fit in transmitter receiving structure 13, wireless components are available that will universally adapt to any system 12. Most transmitters 14 have the ability to report multiple events. In addition to alarm signals from unauthorized access, wireless transmitters 14 can signal weak battery life and tamper alerts to a controller 25 of the security system 12.

Preferred requirements for transmitters 14 for the case 10 are that they be self-contained, battery-powered, have hard-wire input terminals 27, and are capable of transmitting alarm data, typically via radio frequency, to a compatible receiving unit 21 located in, or adjacent to, an electronic security system controller 25. In a simple form, the transmitter 14 interprets a low electrical impedance or normally-closed switch-condition across the terminals 27 as normal, with an opening of a circuit across the terminals 27 as an alarm condition. To achieve this in the simple form described, each of the sensors 15-18 is connected in series by the wiring 24 and presents a normally closed circuit, so that the opening of any one (a logical OR input) triggers an alarm condition, to which the transmitter 14 responds by sending an alarm signal to the security system 12. As such, the wiring itself serves as a sensor in that, if cut or interrupted in any way will open the circuit and thereby detect an alarm condition.

Opening the case 10, for example, results in an opening of magnetic switch 15, for which a switch portion 15*a* is located on one of either moveable or stationary portions, 31 and 32, respectively, of the case 10, with a magnet portion 15*b* being located on the other. When the two portions 31,32 are separated by opening the case 10, an "open" condition of the switch 15*a* occurs. However, if a correct lock combination is entered via the lock mechanism 19 prior to opening the lid 31, access is authorized, and a normally open bypass switch 35 is closed, which bypasses all of the sensor switches 15–18 and prevents the signaling of an alarm condition. In contrast, if access is unauthorized, then neither the switch 15 nor any of the other sensors is bypassed, an alarm condition occurs, which is detected as an open circuit across the terminals 27 of the transmitter 14, which triggers the transmitter to send a signal to the controller 25, which in turn may sound an alarm, send a signal to alert authorities or otherwise respond to the alarm condition.

The case 10 may be configured to be mounted in a fixed location. In the illustrated embodiment, a sensor 16 is provided which, when the case 10 is moved, detects the motion and opens the circuit 24 causing the transmitter 14 to respond to an alarm condition. To this end, the case 10 may be manufactured to cooperate with a support surface. For example, pre-drilled mounting holes 41 in the bottom of the stationary portion 32 of the case 10 can be provided for simple attachment of the case 10 to a fixed surface. For convenience in certain installations, a separate base plate accessory 40 may be made available. The plate 40 may be provided with mounting posts 42 that align with the holes 41 when the case 10 is supported on the plate 40. Once mounted on the plate 40 with the posts 42 in the holes 41, the sensor 16 in the case 10 contains a switch, such as magnetic switch 16*a*, that remains normally closed. Lifting or manipulation of the case 10 causes the switch of the sensor 16 to open, detecting the movement of the case 10 from its normal resting place. With a dedicated support such as the plate 40, a magnet 16*b*, or other cooperating component of the sensor 16, precisely defines the normal resting position of the case 10.

Alternatively, a one-piece sensor 16 such as a simple mechanical switch may be used in the bottom of the case to detect when the case 10 is lifted from any supporting surface. Similarly, a mercury switch, an acoustic switch, an inertial switch or some other type of sensor may be incorporated within the base to detect any subtle movements of the case 10. Other higher technology sensing devices may also be used.

In an emergency situation, immediate access to a firearm may be critical. An authorized user can be provided with the ability to enter the case 10 within seconds and have the firearm in possession, ready to use. Since opening the case 10 with the correct combination bypasses the wireless transmitter and prevents an alarm, the weapon would be retrieved in silence. At this moment, after gaining control of the gun, some users may wish to manually trigger an alarm to alert authorities. For such a situation, a panic button 46 may be provided, which breaks the circuit 24 even if the bypass switch 35 has been closed. Alternatively, re-locking the case 10 with its lid 31 in the open position can be made an option, which would open the bypass switch 35 and initiate an alarm that would summon the police or otherwise signal the monitoring facility 20 without further distraction. The locking mechanism 19 may alternatively be an electronic locking mechanism, or may otherwise be made to offer secondary codes to automatically signal duress situations when unlocked.

Unauthorized attempts to gain control of the firearm 11 through tampering with the the locking mechanism, by cutting away portions of the case to gain access to the interior, by prying off the cover, or through some other method of compromising a secured firearm may be attempted. To protect against such attempts, the case 10 may be designed with other safeguards. For example, a knob (not shown) may be provided for the locking mechanism that breaks off if excessive force is applied. The wiring 24 for the interior devices may be routed in a manner that will result in the circuit being broken if the case is cut, thereby effectively preventing cutting of the case without triggering the alarm. A saw blade or other cutting tool that penetrates a case 10 so wired, would then eventually sever one of the sensor wires, in turn activating the alarm. Further, the case itself may be made of a material that may itself be made part of the alarm circuit. Also, the prying open of the lid would separate the magnet switch 15*a* from its magnet 15*b* and cause the triggering of an alarm.

Providing a non-locking case 10 for a firearm 11 would allow for immediate access to the firearm. With such a case, an alarm would be generated upon an opening of the case 10 without the entry of an access code, but the weapon would be in an unauthorized users control. A locked case 10 minimally slows authorized availability to the firearm 11 but more effectively prevents unauthorized users from obtaining the weapon. The balancing of the need for authorized access with the need for security and the need for simple operation with safety must be made. Accordingly, locking the case 10 is a much more preferable option, as long as entry of the access code is quick and simple. To this end, sophisticated systems of authorized user identification may be useful.

Lock features and potential real life scenarios must be considered when selecting the most effective locking device. Access in dim or unlit environments, quiet functioning, keyless access, changeable combinations, tamper proof operation, proven performance in a multitude of applications, and ease of operation by the end user are a some key elements that would be advantageous. For a non-powered version of the case 10, mechanical pushbutton lock may, for example, be utilized. Alternatively, if an electronic lock is used, it may contain a programmed feature for signaling an alarm condition when one or more failed attempts is made to enter a code or combination.

A variety of combinations of sensors 15–18 or alternatives thereto may be utilized within the case 10 to detect alarm conditions. The combination may vary dependent on the type of contents the case 10 is designed to hold. Mechanical sensors, as illustrated, may be utilized, and are the simplest. Magnetic switches that include a magnet and a micro reed switch in combination are also simple, as described above for use to detect when the case 10 is opened or removed from the mounting plate 40. Plunger switches that include spring-loaded plastic or metal pins that activate a signal when either compressed or expanded are also simple and particularly useful for an emergency panic button or on the mounting plate.

Other bypass switches, such as bypass switch 35, can be provided to maintain continuity in an alarm circuit to disengage any or all sensors and allow access or movement of the case 10 without causing an alarm.

Optional mercury switches or other inertial movement detection devices, which upon the slightest movement, can cause the reporting of an alarm condition, can be used in the case 10. Such sensors can be useful, particularly in installations having base plate 40, or in other installations where unauthorized movement of the case 10 could occur.

Wiring 24 of various gauges may be used to connect all the sensors in the case 10 to the wireless transmitter 14. Such wiring 24 is part of the alarm circuit and may itself be considered a sensor, in that, if it is severed, it creates an open circuit and causes the transmitter 14 to signal an alarm condition.

The built in structure 13 forms a designated compartment in which the sensor wiring 24 terminates. At the end of the sensor wiring 24 in this compartment, two wire leads of ample length are coiled to allow for an unencumbered, simple connection to a wireless transmitter 14 or other connectivity hardware.

To complete the installation of a case 10, an alarm vendor may install in the compartment structure 13 a transmitter 14 that is compatible with the users security equipment 12, and determine optimal programming for the alarm controller 25. The case 10 would then be ready to detect alarm conditions and transmit this information to monitoring facility 20 via the customers security system 12.

There are several installation methods that would accommodate varying needs. Horizontal surface installation of the case 10, with a magnetic or plunger type switch, to protect the case against unauthorized movement, for example, is a common preference by users. The case 10 as illustrated with the pre-drilled holes 41 in its base portion 32 allow attachment to a suitable surface using a base plate 40. Mounting locations must be evaluated for stability, and to ensure that the selected mounting surface is inherently stationary or cannot otherwise be removed with the case 10 attached. Vertical surface installation is also possible with a magnetic, plunger type or other type of switch used to detect removal of the case 10 from a hanging position on a vertical surface. The predrilled holes 41, for example, in the base 32 can allow for installation to wall studs. Once so mounted, the sensor 16 in the base detects detachment from the wall. When mounting the case vertically, optional structure is desirable to hold the firearm or other contents.

For both horizontal or vertical installations, some users may prefer to have the ability to remove the case 10 from its affixed position when accessing the firearm 11. This can become cumbersome if the case is directly bolted to a surface through its base or otherwise where tools might be required to lift the case 10 from its installed position. In these situations, structure may be provided that would allow for easy removal and replacement. The case 10, with such structure, would detach from structure that remains bolted in position. This may be achieved using a code entry device in a manner similar to the opening of the case 10.

For installations that do not permit secure, direct attachment of the case 10 to a fixed surface utilizing pre-drilled mounting holes or some other structure, threaded studs that align with the case's pre-drilled holes and thumb screws can be used to mount the case 10. For horizontal surface mounting, a series of holes around the perimeter of mounting plate 40, for example, may be provided to allow for maximum flexibility in positioning. For wall mounting, the location of a wall stud may limit flexibility in positioning the case while utilizing the pre-drilled holes in the base. But structure can be provided that allows the case 10 to be positioned in the desired location by utilizing alternative mounting structure.

An "alarm-ready" case 10, as described above, is particularly useful to store a handgun or long gun in a home or other structure. The case 10 is most useful for a person whose home or other structure in which the firearm or other valuable is to be stored is already protected by an alarm or security system 12, and will be connected with the system as illustrated in FIG. 2.

The alarm system 12 is typically of a type in which intrusion or fire or another event is detected by one or more sensors and which communicates the detection of such an alarm condition to some central office 20 that reports the event to fire or police departments or otherwise responds to the alarm signal. Such alarm systems 12 usually have perimeter sensors at doors and windows of the facility and motion detectors throughout the facility that are hard-wired to the alarm controller 25 of the system 12. The system 12 also typically accepts sensors linked to the system through wireless transmitters, particularly in retrofitted situations where the installation of wiring is difficult. The alarm systems may be made by different manufacturers, and may use wireless transmitters that are not interchangeable with systems of other manufacturers.

The case 10 of the present invention is called "alarm-ready" because it is equipped, not with an installed wireless transmitter 14, but with a plurality of sensors, connectable to an alarm transmitter 14 or other communication capability, which it will accept of any of a number of varieties. The sensors include a sensor to detect that the case has been opened or tampered with, and a sensor to detect that the case has been moved from the location at which it has been set. It is also provided with mounting structure to support a wireless transmitter 14 of any of a number of different alarm systems 12 of different manufacturers and with wiring equipped to connect the sensors to any such transmitter 14.

The transmitter 14, in its most common form, will be a small RF transmitter of a type usually used in a facility installed alarm system to generate an RF signal that is received by a receiver or detector on a panel on the premises. In the alternative or in addition to such a transmitter, a device can be provided for transmitting directly to a remote monitoring facility, to a computer system or network, or through a communication system. For example, the transmitter may include an ethernet card, a cellular phone system interface, a GPS transmitter or other wireless communication equipment, or may include terminals or circuitry providing a direct, hard-wired output connection.

A lock on the case is provided that may be linked to a sensor to signal that the lock has been opened or tampered with. The lock may or may not be equipped to bypass the alarm sensors when the case is opened using an authorized key or code. The sensors can be magnetic or mechanical or of some other kind that activates when the case is lifted from or moved along the support surface, and a special base mounting plate may be provided with the case 10. Other sensors to detect vibration, heat, smoke or other conditions, as well as a panic button, can be included in the case 10.

The lock on the case may be electronic, in which case batteries or another power source is provided with the case. With such a lock, an external connector on the case may be provided to furnish power to the lock to permit the authorized opening of the case in the event that the batteries or other source of power in the case has failed.

While the case 10 is particularly useful for securing firearms and has been described in such an embodiment, the principles of the invention are useful in securing other items such as jewelry, currency, securities, drugs and other objects and substances, particularly those to which a user might want easy access and might want specifically protected by a facility alarm system.

What is claimed is:

1. An alarm ready case for securing articles in the interior thereof comprising:

a base having an openable lid enclosing an interior space;

a lock having interacting structure on the base and the lid for locking the lid in a closed position on the base;

at least one sensor mounted to the case and operable to detect at least one alarm condition arising from a breach of security of contents of the interior space;

receiving structure configured to receive and support on the case a wireless transmitter of a plurality of different facility security systems; and circuitry on the case, the circuitry being configured to connect the at least one sensor to a wireless transmitter supported by the receiving structure, and to communicate the alarm condition from the at least one sensor to the transmitter in response to a breach of security of the interior space.

2. The case of claim 1 for securing a firearm in the interior thereof wherein:

the base has an opening and the lid is moveable relative to the base between a closed position that closes the opening and encloses an interior space within the case and an open position that permits the inserting and removal of a firearm into and from the interior space;

the receiving structure includes an article support in the interior space configured to support a firearm;

the at least one sensor includes at least one sensor operable to detect at least one alarm condition arising from a breach of security of the interior space, the alarm condition being from the group of conditions consisting of opening of the case, tampering with the case, movement of the case, removal of a firearm from the article rest, and penetration of the case.

3. The case of claim 1 wherein:

the lock is a mechanical lock having interacting structure on the base and the lid for locking the lid in the closed position;

the at least one sensor includes a plurality of passive sensors each operable to detect a different alarm condition associated with a breach of security of the case, each of the sensors presenting a normally closed circuit in the absence of the respective alarm condition and an open circuit in the presence of the respective alarm condition.

4. A facility security system comprising the case of claim 1 and further comprising:

a wireless transmitter supported in the receiving structure and connected to the circuitry thereof so as to respond to an alarm condition sensed by a sensor thereof and transmit a signal; and a facility alarm system having a receiver operative to receive a signal transmitted by the transmitter and to signal an alarm in response thereto.

5. A method of securing an article comprising the steps of:

providing each of a plurality of cases with:

a space therein for placement of an article to be protected, at least one sensor mounted to the enclosure and operable to detect at least one alarm condition arising from a breach of security of contents of the interior space; and connectivity structure configured to connect the at least one sensor to means compatible with at least one of a plurality of different security systems for communicating thereto a condition detected by the at least one sensor; and allocating least two cases of the plurality, each for use with a different one of a plurality of different security systems, the allocated cases being allocated without connectivity structure connected to a security system.

6. A method of securing a firearm according to the method of claim 5 further comprising:

placing a firearm in the interior space of the case;

locking the case;

connecting the connectivity structure to means compatible with a security system operable to receive a signal to the security system indicating a condition detected by the at least one sensor.

7. The method of claim 5 wherein:

the connectivity structure includes receiving structure configured to support a wireless transmitter compatible with at least one of the plurality of security systems and conductors for connecting the wireless transmitter to the at least one sensor.

8. The method of claim 5 wherein:

the connectivity structure includes terminals configured to connect the at least one sensor to at least one of the plurality of security systems.

9. The method of claim 5 wherein:

the connectivity structure includes a connector configured to receive an interface card and to connect the at least one sensor thereto, the card being compatible with at least one of the plurality of security systems for communicating thereto a condition detected by the at least one sensor.

10. A case for securing articles in the interior thereof for protection by any of a plurality of security systems, the case comprising:

an openable enclosure having an interior space;

a lock on the enclosure for locking the enclosure with the interior space enclosed therein;

at least one sensor mounted to the enclosure and operable to detect at least one alarm condition arising from a breach of security of contents of the interior space; and connectivity structure on the enclosure configured to connect the at least one sensor to at least two different means compatible with at least one of the plurality of security systems for communicating thereto a condition detected by the at least one sensor.

11. The case of claim 10 for securing a firearm in the interior thereof wherein:

the enclosure has a base having an opening and a lid for closing the opening, the lid being moveable relative to the base between a closed position that closes the opening and encloses an interior space within the case and an open position that permits the inserting and removal of a firearm into and from the interior space;

the enclosure has receiving structure in the interior space configured to support a firearm;

the at least one sensor includes at least one sensor operable to detect at least one alarm condition arising from a breach of security of the interior space, the alarm condition being from the group of conditions consisting of opening of the case, tampering with the case, movement of the case, removal of a firearm from the article rest, and penetration of the case.

12. The case of claim 10 wherein:

the lock is a mechanical lock; and the at least one sensor includes a plurality of passive sensors each operable to detect a different alarm condition associated with a breach of security of the case, each of the sensors presenting a normally closed circuit in the absence of the respective alarm condition and an open circuit in the presence of the respective alarm condition.

13. The case of claim 10 wherein:

the connectivity structure includes conductors configured to connect the at least one sensor to a wireless transmitter compatible with at least one of the plurality of security systems for communicating thereto a condition detected by the at least one sensor.

14. The case of claim 10 wherein:

the connectivity structure includes conductors configured to connect the at least one sensor to conductors extending to a central panel of a facility security system for communicating thereto a condition detected by the at least one sensor.

15. The case of claim 10 wherein:

the connectivity structure includes a connector configured to receive an interface card and to connect the at least one sensor thereto, the card being compatible with at least one of the plurality of security systems for communicating thereto a condition detected by the at least one sensor.

16. The case of claim 10 wherein:

the connectivity structure includes a connector configured to receive an ethernet card and to connect the at least one sensor thereto, the card being compatible with at least one of the plurality of security systems for communicating thereto a condition detected by the at least one sensor.

17. The case of claim 10 wherein:

the connectivity structure includes a connector configured to receive a cellular telecommunications card and to connect the at least one sensor thereto, the card being compatible with at least one of the plurality of security systems for communicating thereto a condition detected by the at least one sensor.

18. The case of claim 10 wherein:

the connectivity structure includes means for communicating information regarding the detecting condition to at least one of the plurality of security systems.

19. The case of claim 10 wherein:

the connectivity structure includes means for communicating information regarding the location of the case to at least one of the plurality of security systems.

20. A facility security system comprising the case of claim 10 and further comprising:

connectivity hardware supported in the receiving structure and connected to the circuitry thereof so as to respond to an alarm condition sensed by a sensor thereof and transmit a signal; and a facility alarm system having a receiver operative to receive a signal transmitted by the connectivity hardware and to signal an alarm in response thereto.

21. A case for securing articles in the interior thereof for protection by a security system, the case comprising:

an openable enclosure having an interior space;

a lock on the enclosure for locking the enclosure with the interior space enclosed therein;

at least one sensor mounted to the enclosure and operable to detect at least one alarm condition arising from a breach of security of contents of the interior space; and means on the enclosure for connecting the at least one sensor to a plurality of different facility security systems for communicating thereto a condition detected by the at least one sensor.

* * * * *

UNITED STATES PATENT AND TRADEMARK OFFICE

CERTIFICATE OF CORRECTION

PATENT NO. : 7,116,224 B2
APPLICATION NO. : 10/681432
DATED : October 3, 2006
INVENTOR(S) : Kerry L. Mickler It is certified that error appears in the above-identified patent and that said Letters Patent is hereby corrected as shown below:

Column 12, line 17, CLAIM 5, reads "allocating least two cases of the plurality" and should read --allocating at least two cases of the plurality--.

Signed and Sealed this

Third Day of April, 2007

JON W. DUDAS
*Director of the United States Patent and Trademark Office*